US009700089B2

(12) United States Patent
Clore-Gronenborn

(10) Patent No.: US 9,700,089 B2
(45) Date of Patent: Jul. 11, 2017

(54) SECURITY POCKET

(71) Applicant: Sebastian Clore-Gronenborn, Bethesda, MD (US)

(72) Inventor: Sebastian Clore-Gronenborn, Bethesda, MD (US)

( * ) Notice: Subject to any disclaimer, the term of this patent is extended or adjusted under 35 U.S.C. 154(b) by 312 days.

(21) Appl. No.: 14/452,248

(22) Filed: Aug. 5, 2014

(65) Prior Publication Data

US 2015/0296908 A1 Oct. 22, 2015

Related U.S. Application Data

(60) Provisional application No. 61/982,221, filed on Apr. 21, 2014.

(51) Int. Cl.
*A41D 27/20* (2006.01)

(52) U.S. Cl.
CPC ..... *A41D 27/20* (2013.01); *A41D 27/204* (2013.01)

(58) Field of Classification Search
CPC ..... A41D 27/20; A41D 27/204
USPC ..... 2/227, 247, 250, 253
See application file for complete search history.

(56) References Cited

U.S. PATENT DOCUMENTS

| | | | | |
|---|---|---|---|---|
| 994,873 | A | 6/1911 | Rogers | |
| 1,257,048 | A | 2/1918 | Tamas | |
| 2,236,694 | A | 4/1941 | Oppenheimer | |
| 4,499,612 | A | 2/1985 | Koike | |
| 4,513,455 | A | 4/1985 | Gerhardt | |
| 4,553,269 | A | 11/1985 | Nowak | |
| 4,648,121 | A * | 3/1987 | Lowe | A45F 3/04 224/259 |
| 5,638,549 | A * | 6/1997 | Thomas | A41D 27/207 2/247 |
| 5,669,078 | A | 9/1997 | Scremin et al. | |
| 6,363,538 | B1 | 4/2002 | Davis | |
| 8,402,562 | B1 | 3/2013 | Seddiki | |
| 8,566,963 | B2 | 10/2013 | Ryan | |
| 2002/0157170 | A1 | 10/2002 | Lipscher | |
| 2005/0000001 | A1 | 1/2005 | Goldkind | |

(Continued)

FOREIGN PATENT DOCUMENTS

| | | |
|---|---|---|
| AU | 2003257497 | 5/2004 |
| CN | 2445606 | 7/1999 |

(Continued)

OTHER PUBLICATIONS

Ultimate Cargo Pants from SCOTTEVEST/SeV with Concealed Pockets for Travel—Men's Zip-off Secure Pocket Pant, Lightweight Convertible Khakis Convert to Shorts; http://www.scottevest.com/V3_store/ultimate-cargo-pants.shtml.

(Continued)

*Primary Examiner* — Katherine Moran
(74) *Attorney, Agent, or Firm* — Grasso PLLC

(57) ABSTRACT

Included herein are multiple pocket systems orientated along a seam or other shared axis of positioning where a primary pocket is provided and a subordinate secondary pocket is accessible through the primary pocket. In so doing the primary pocket may be positioned before the subordinate secondary security pocket and user access to the higher pocket and the subordinate security pocket may lie along the same positioning axis where access to the security pocket is primarily achieved after passing into the primary pocket.

19 Claims, 17 Drawing Sheets

(56) References Cited

U.S. PATENT DOCUMENTS

| | | | | |
|---|---|---|---|---|
| 2007/0266478 | A1* | 11/2007 | Girod | A41D 1/00 2/227 |
| 2009/0025117 | A1 | 1/2009 | French | |
| 2009/0222974 | A1 | 9/2009 | Walburg | |
| 2010/0000003 | A1 | 1/2010 | O. | |
| 2011/0078840 | A1 | 4/2011 | Thompson | |
| 2011/0314592 | A1* | 12/2011 | Wells-Chubb | A41D 27/20 2/247 |
| 2012/0117713 | A1 | 5/2012 | Hoffner | |
| 2013/0239298 | A1 | 9/2013 | Jordan et al. | |
| 2013/0325648 | A1 | 12/2013 | Kanner | |
| 2014/0061273 | A1 | 3/2014 | Bullivant | |

FOREIGN PATENT DOCUMENTS

| | | |
|---|---|---|
| CN | 203121112 | 8/2013 |
| CN | 103504562 | 1/2014 |
| CN | 203424366 | 2/2014 |
| GB | 285024 | 5/1928 |
| WO | 9749307 A1 | 12/1997 |

OTHER PUBLICATIONS

Hidden Cargo Pants 2.0; http://www.scottevest.com/v3_store/hidden_cargo_pants2.shtml#pd_video; © 2000-2014 SCOTTEVEST, Inc. and TEC-Technology Enabled Clothing® A Rights Reserved.

Wade Shepard; Hidden Pockets to Carry Travel Valuables; http://www.vagabondjourney.com/hidden-pockets-to-carry-travel-valuables/.

Hidden Pockets; http://cubicleditcher.vagabondjourney.com/hidden-pockets/; by Sam on Apr. 13, 2010.

Matthew Karsten; How To Make a Secret Pocket in Your Pants!; http://expertvagabond.com/secret-travel-pocket/.

Hot Jerry Valentine; How to make an easy hidden pocket; http://www.instructables.com/id/How-to-make-an-easy-hidden-pocket/.

Julie Strietelmeier; Update: SCOTTeVEST Hidden Cargo Pants Review; Sep. 17, 2004; The Gadgeteer; Copyright © 2014 All Rights Reserved; http://the-gadgeteer.com2004/09/17update_scottevest_hidden_cargo_pants_review/.

International Search Report and Written Opinion PCT Application PCT/US2015/026207 Jul. 14, 2015.

* cited by examiner

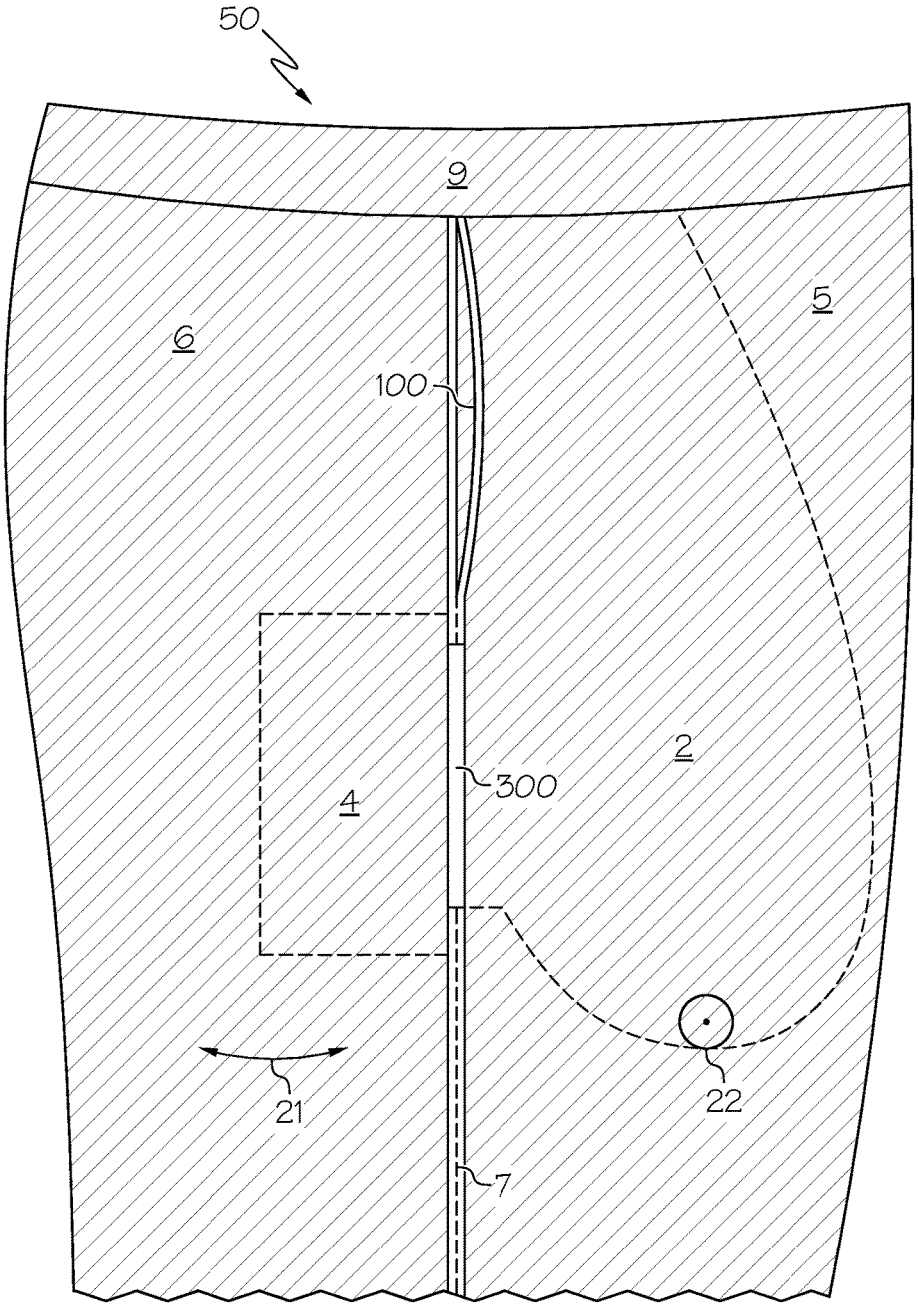
FIG. 2
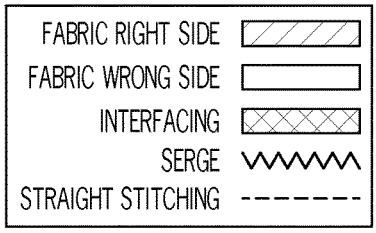

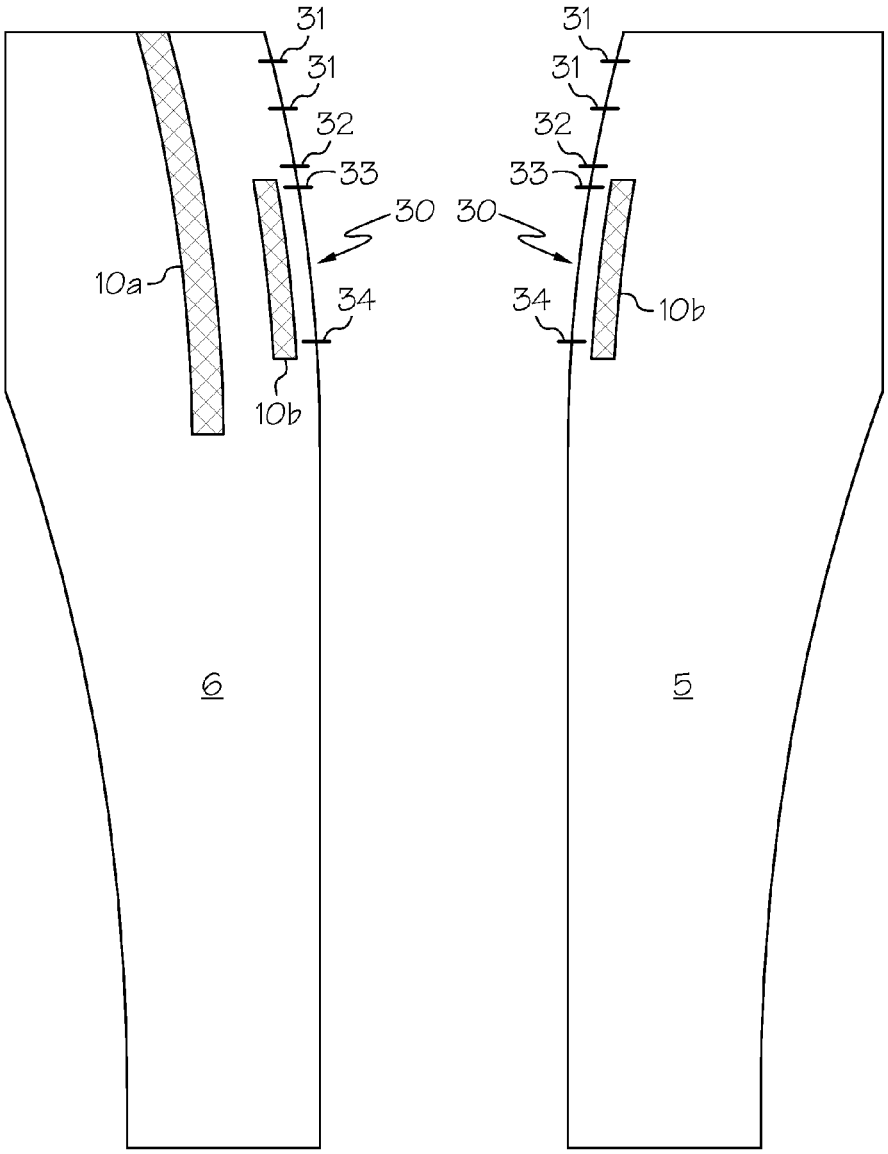
FIG. 3
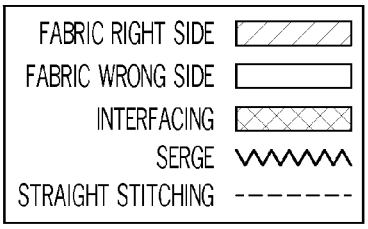

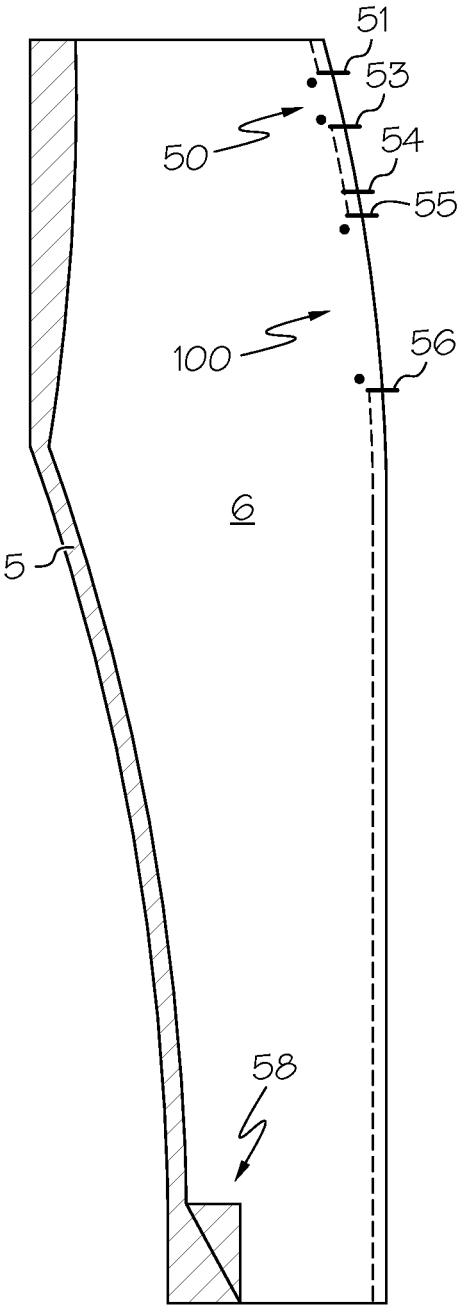
FIG. 5
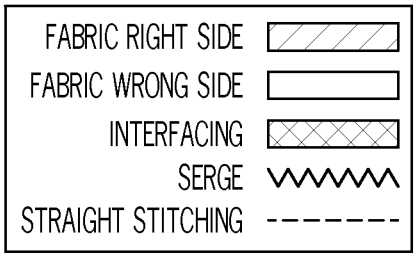

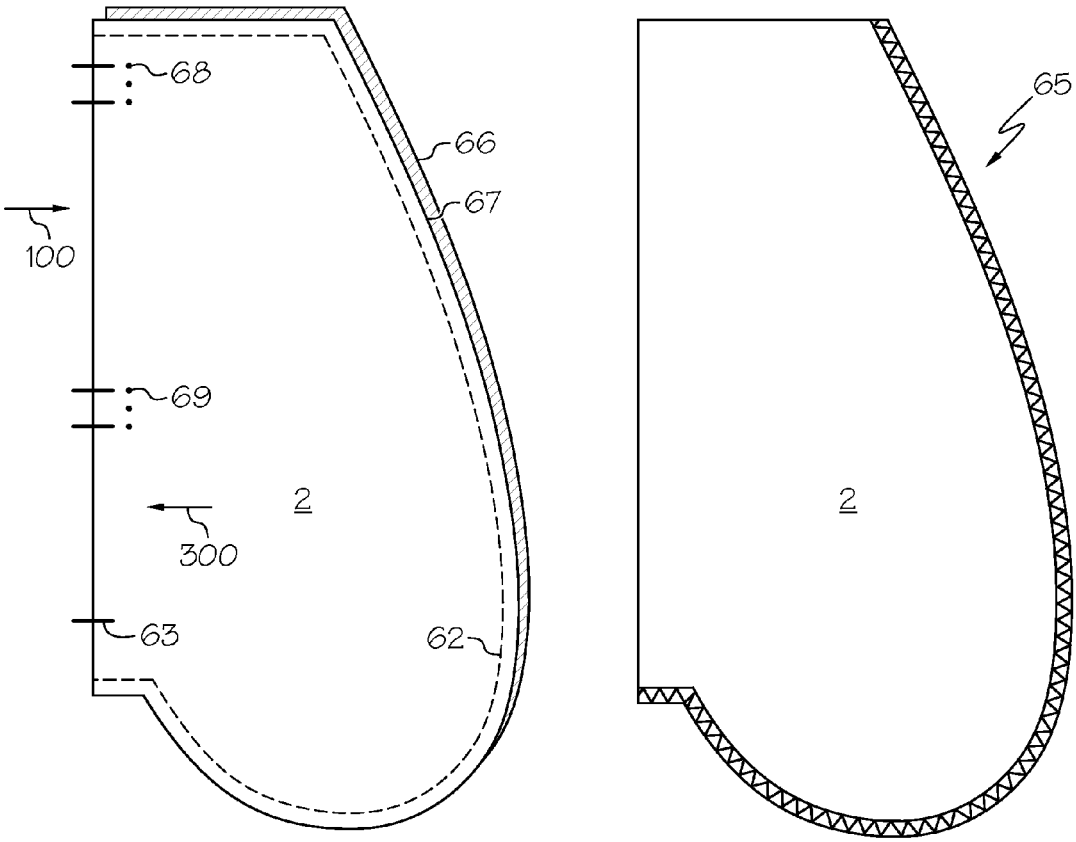
FIG. 6
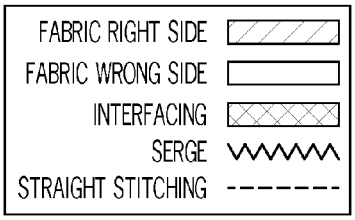

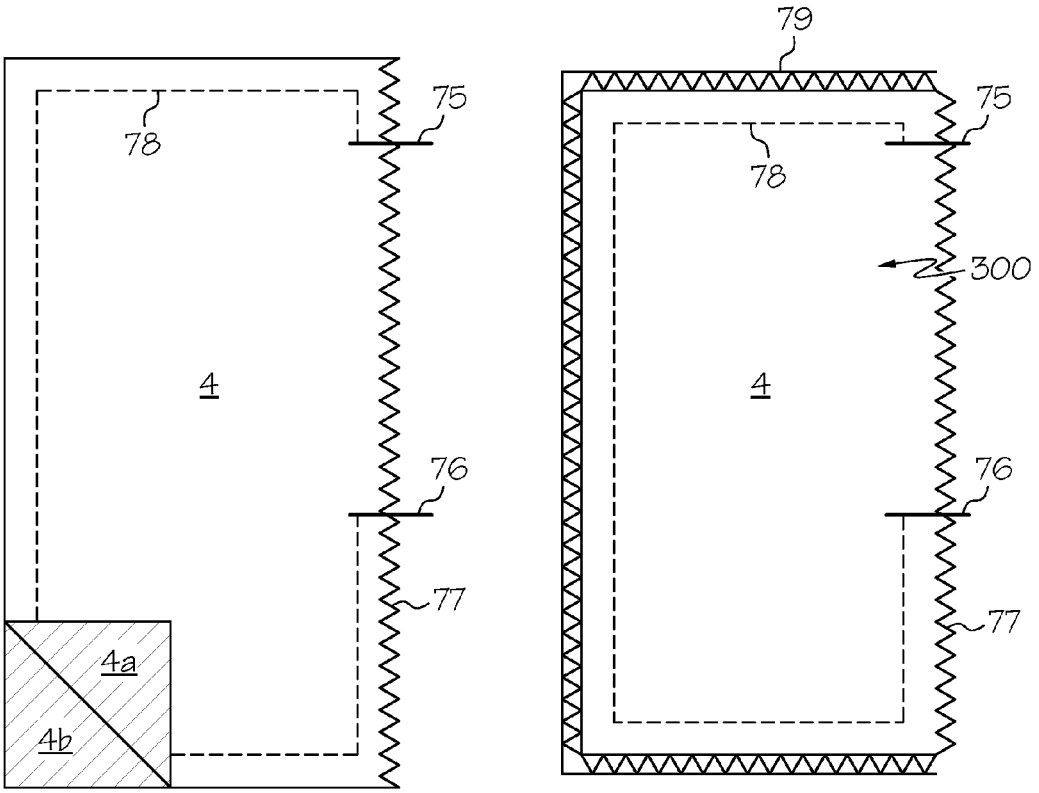
FIG. 7
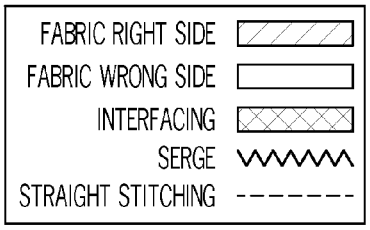

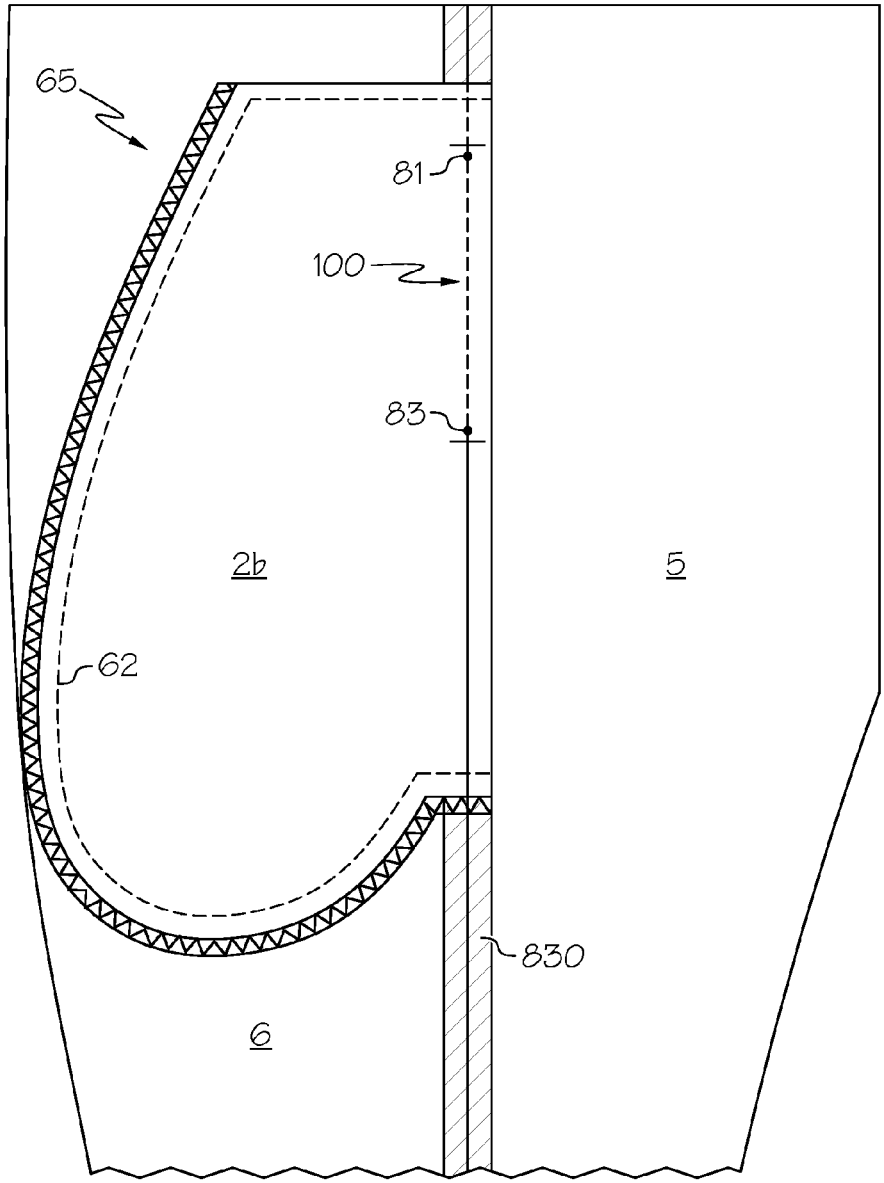
FIG. 8
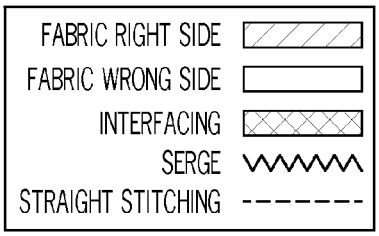

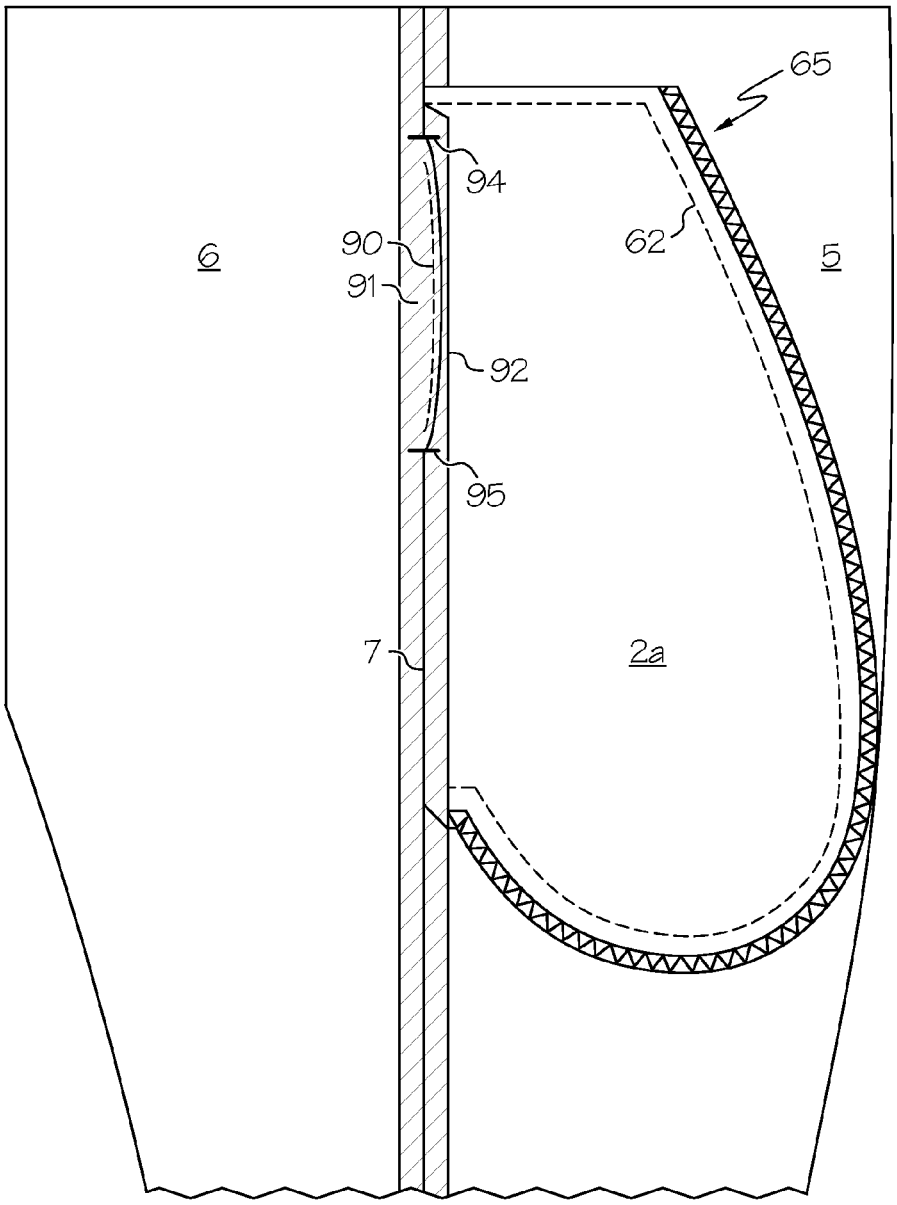
FIG. 9
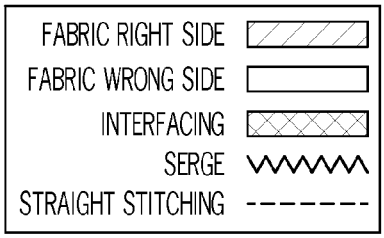

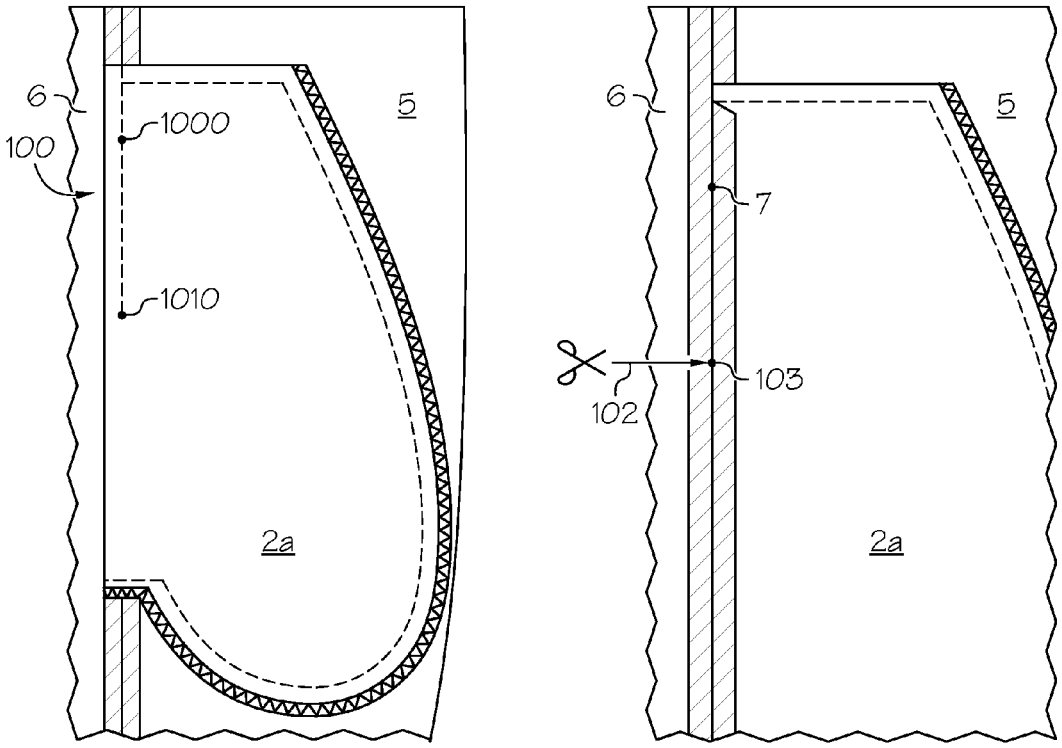
FIG. 10
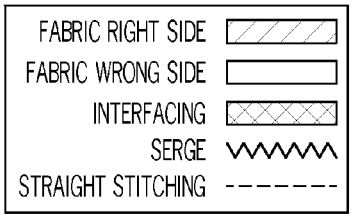

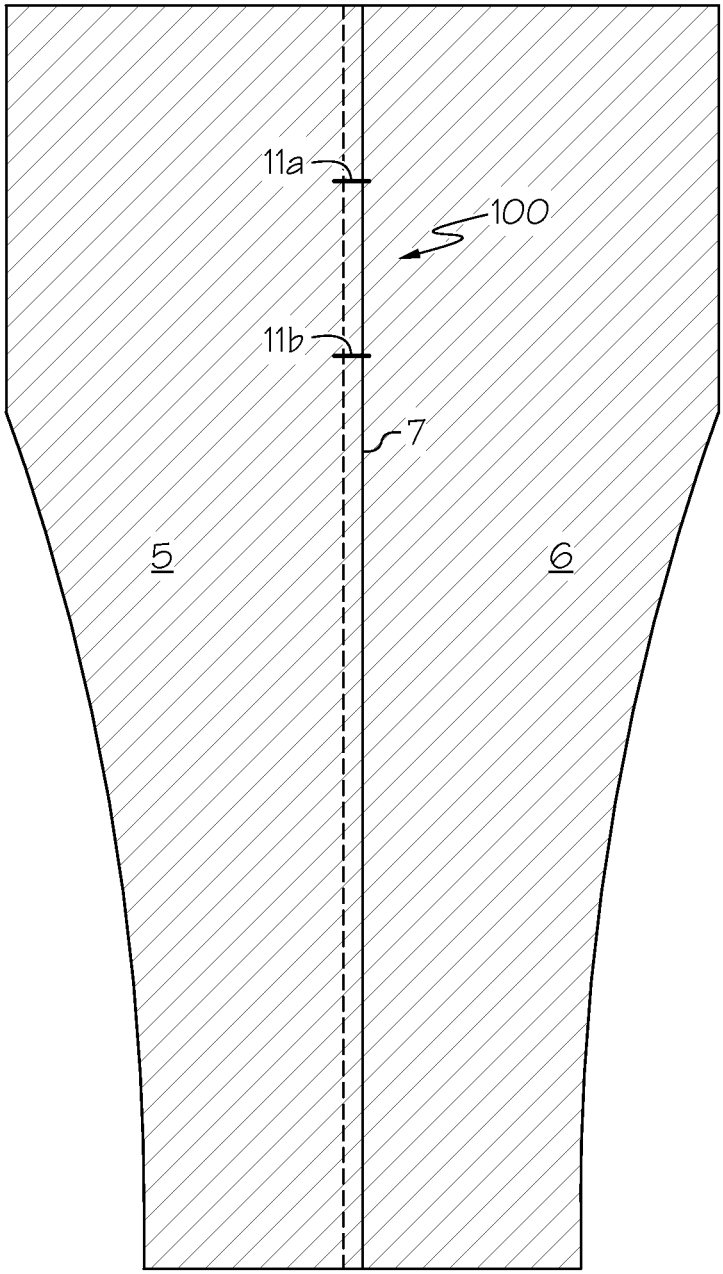
FIG. 11
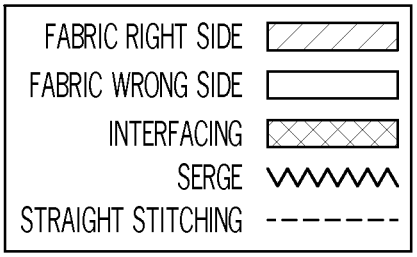

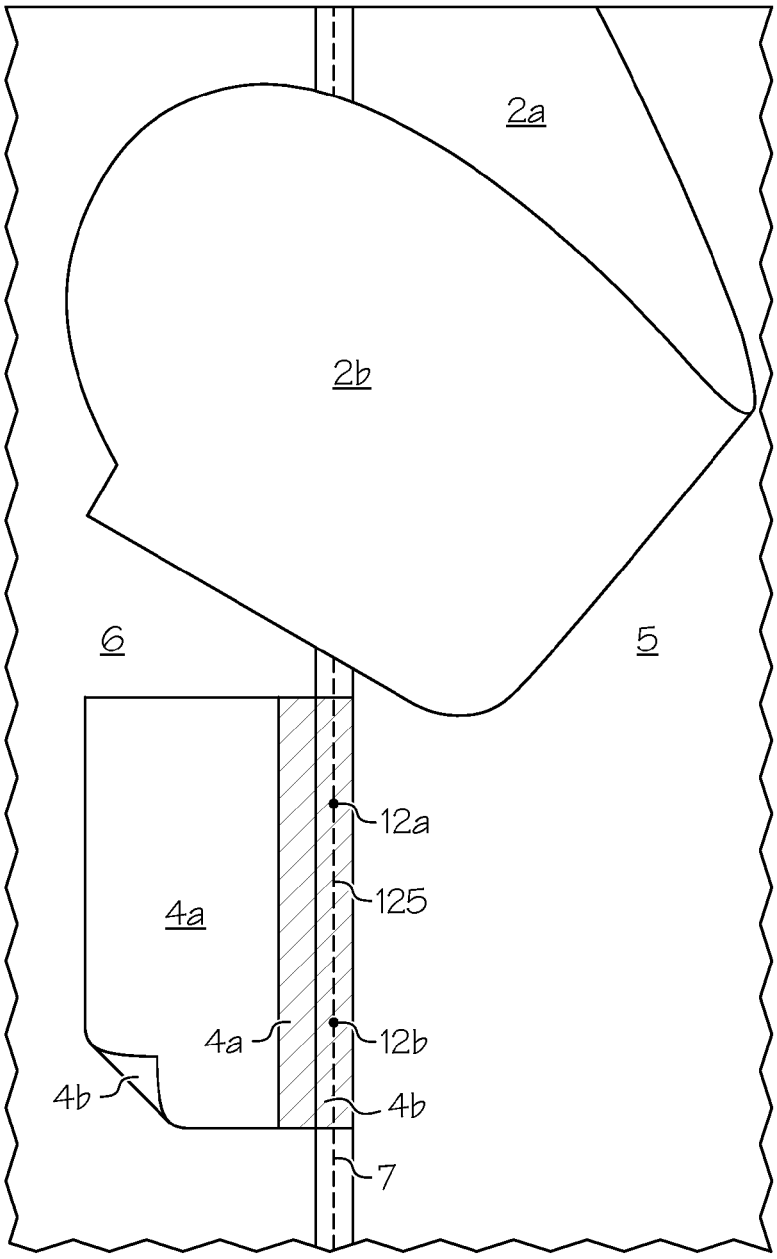
FIG. 12
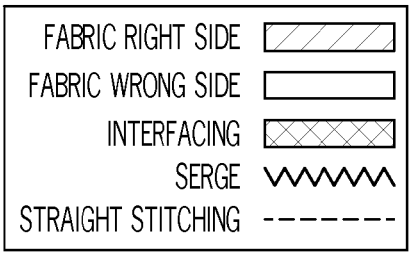

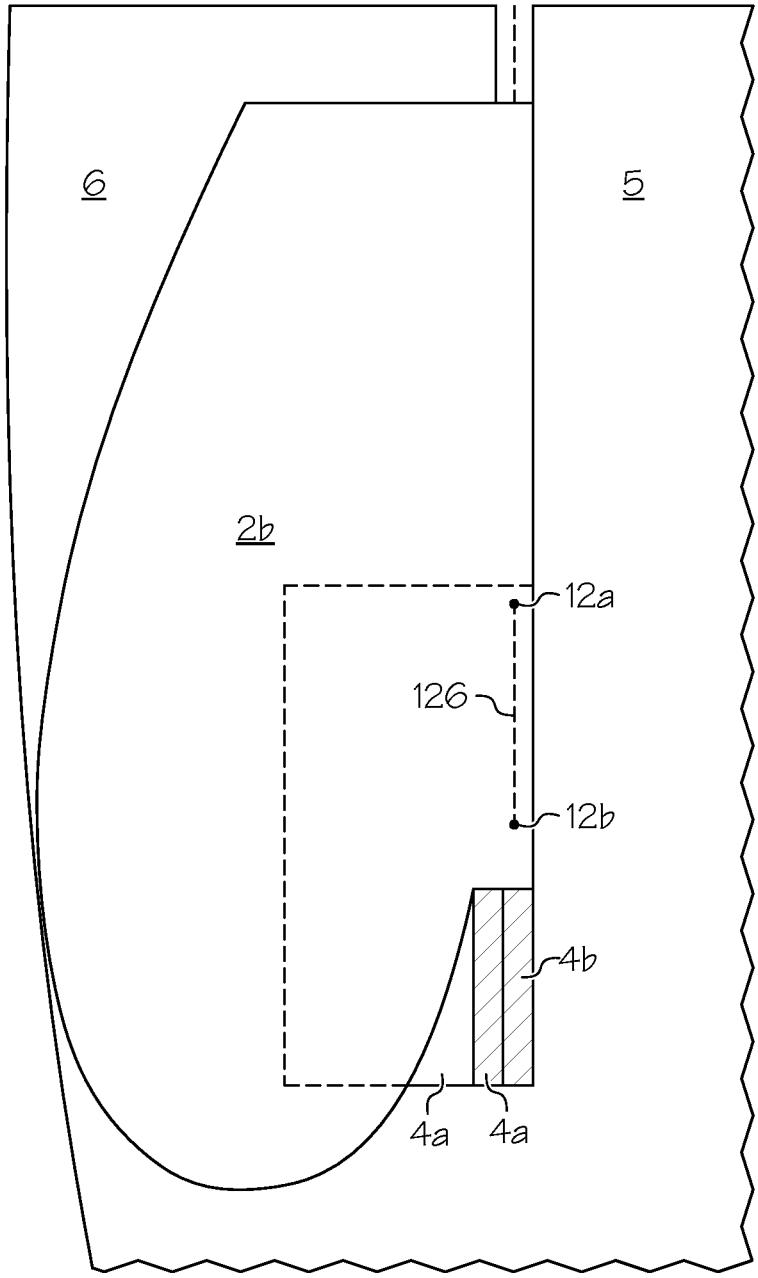
FIG. 13
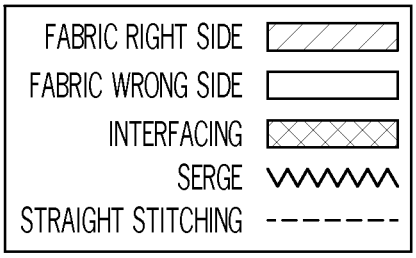

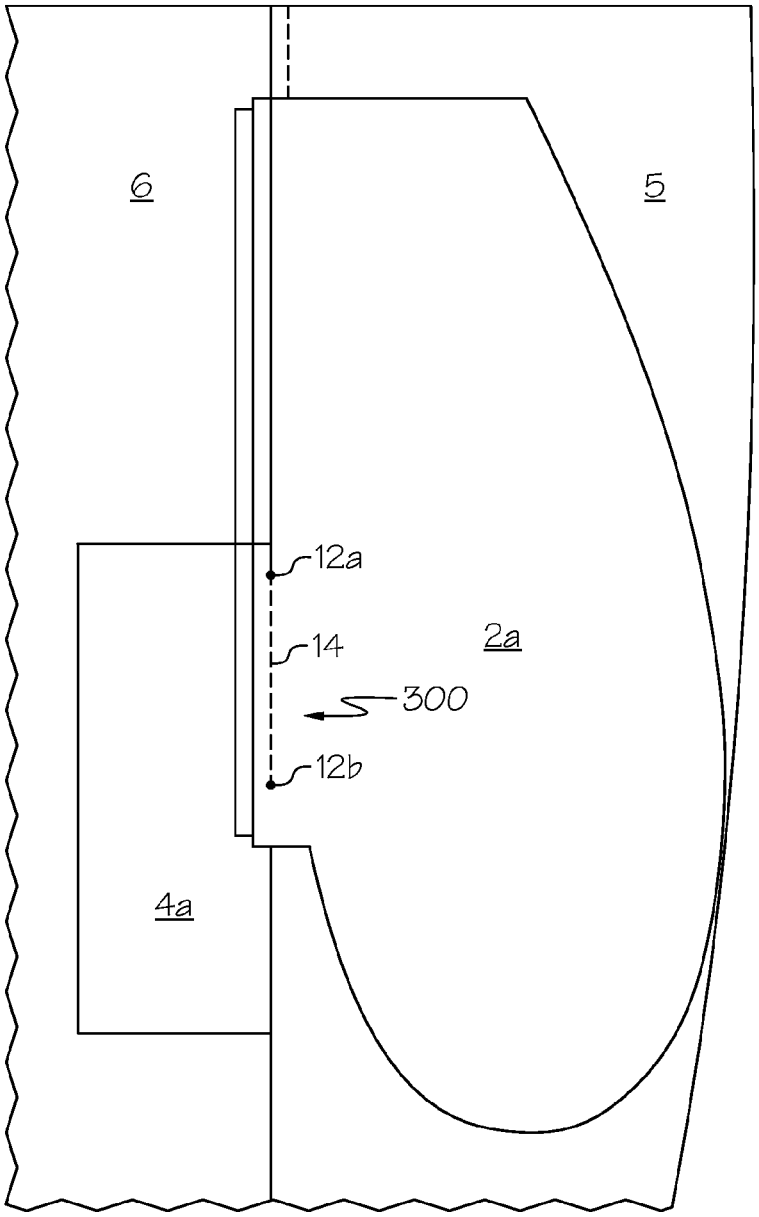
FIG. 14
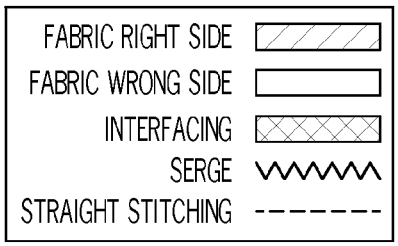

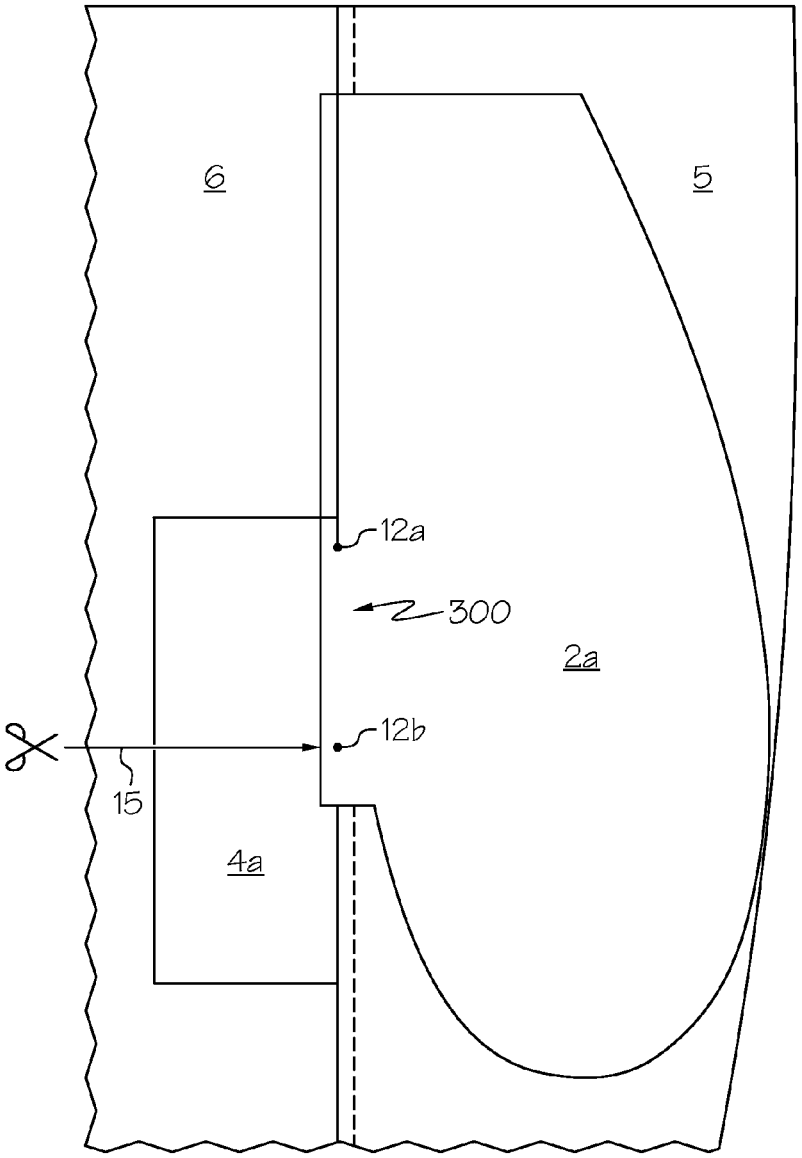
FIG. 15
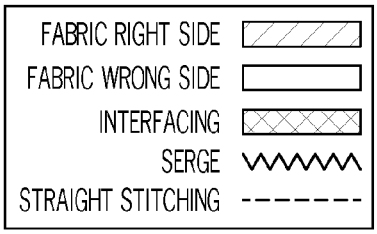

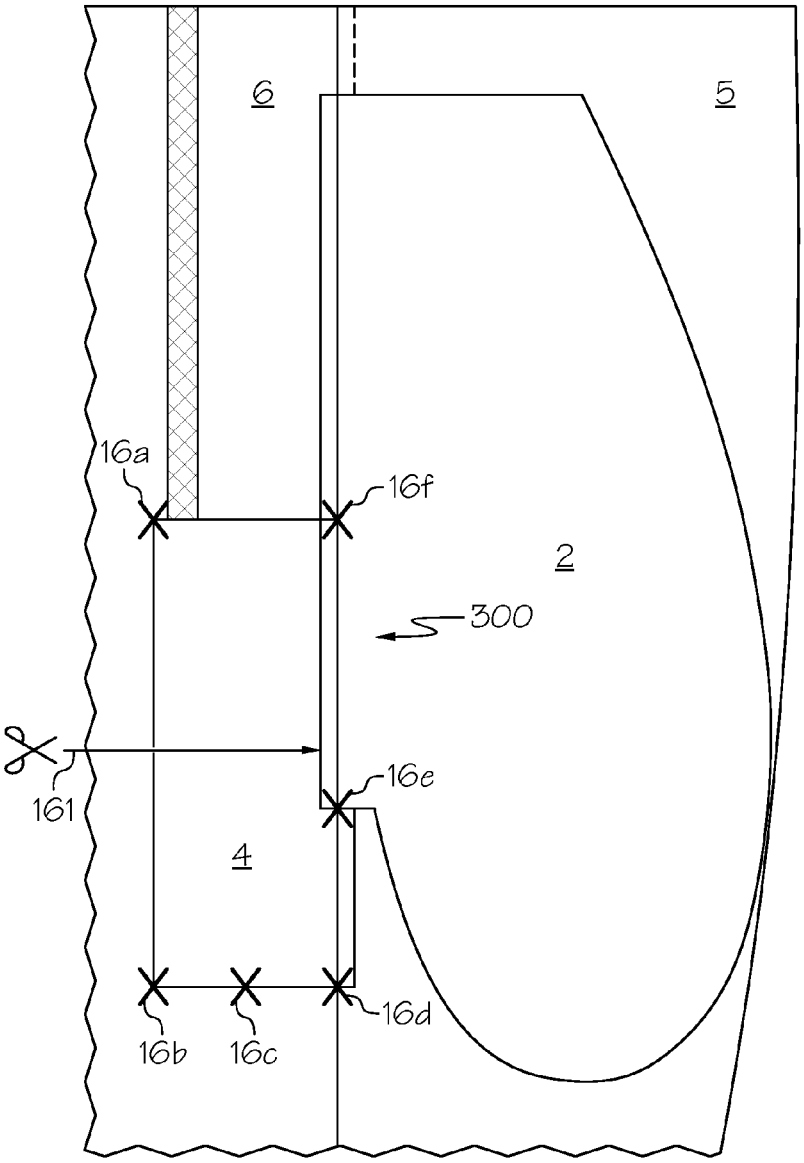
FIG. 16
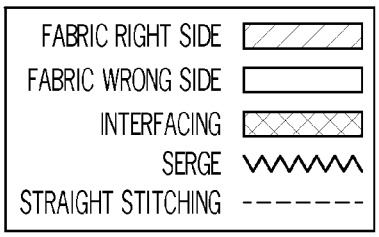

SECURITY POCKET

CROSS-REFERENCE TO RELATED APPLICATION

This application claims priority to and the benefit of U.S. provisional application 61/982,221, which was filed Apr. 21, 2014 and is entitled Garment With Security Pocket. The '221 provisional is incorporated herein by reference, in its entirety, into this application.

BACKGROUND

The present invention relates to multiple pocket systems of sewn items, and more specifically, to a multi-layer fabric combination comprising a primary pocket and a secondary security pocket where access to the secondary security pocket of the multi-layer fabric combination may be made through the primary pocket.

Security belts and wallets chained to a user's pants or belt are methods of carrying valuables or secreting items of a user. Security belts often include a zipper and are removed in order to access the secure and discrete space within the belt. A wallet with security chain is not discrete as its chain can be readily seen hanging about a pants pocket. Likewise, its chain and extra bulk can serve to draw attention to the wallet and its contents. Moreover, when using the chain and wallet, the chain may become snagged and can be a source of discomfort for the user.

FIELD OF THE INVENTION

Embodiments may provide for security pockets in pants, jackets, other garments, totable items, such as backpacks, luggage, and bags, and configurations where security pocket access is maintained through a first pocket and where access to the security pocket may not be readily discernible to a casual observer. Embodiments may include multiple pocket systems orientated along a seam or other shared axis where a primary pocket may be provided and a subordinate secondary pocket may be accessible through the primary pocket. In embodiments, the primary pocket may be positioned higher than the subordinate secondary security pocket and user access to the higher pocket and the subordinate security pocket may lie along the same positioning axis where access to the security pocket is primarily achieved after passing into the primary pocket. In embodiments this positioning axis may be a vertical side seam or a non-horizontal side seam of various orientation axes from a reference horizontal when the garment or non-garment is in use, including ranges between 0° and 90°. Preferably the axis of orientation is aligned at 60° through 90° from a reference horizontal of the garment or non-garment when the garment or non-garment is in use.

Layers of fabric positioned and secured to each other in accord with teachings provided herein may define and shape the pocket system. These layers of fabric may be used in various sewn items including garments and non-garments.

In embodiments, entrance to both the primary pocket and the subordinate secondary security pocket may lie along a vertical seam, an upright seam, or other non-horizontal side seam of a pant leg or other sewn article, where the direction of ordinary user access to the primary pocket may traverse the seam in a first direction and where ordinary user access to the subordinate secondary security pocket may traverse the seam in a second and opposite direction to the first direction. In so doing, in embodiments access to the side pocket comes before access to the security pocket. Embodiments may include shared positioning axes that are at various angles in additional to vertical. An advantage of substantially upright orientations, e.g., from 60°-90° from a reference horizontal of the garment or non-garment when the garment or non-garment is in use, for the positioning axis in embodiments may be the closing force generated in a downward direction on the openings of the primary pocket and the subordinate security pocket when items are placed in the pockets. In other words, in certain embodiments, as an orientation axis becomes more upright the amount of downward force placed on the axis by items in one or both of the pockets can serve to increase the biasing force on one or both pocket openings.

As also described herein methods of manufacture and other processes may also practice and fall within embodiments. These may include processes of assembly of new articles as well as processes to adapt existing articles and like using the teachings provided herein.

These and other embodiments, including processes and articles of manufacture, are provided for herein. Likewise, still further embodiments consistent with the teachings provided are also possible and fall within the scope of the invention. These include embodiments incorporating some features, processes including some actions described herein, and variations of features of either or both, and with or without additional features or modifications.

BRIEF DESCRIPTION OF THE SEVERAL VIEWS OF THE DRAWINGS

The following description of the invention will be further understood with reference to the accompanying drawings.

FIG. 2 shows an exterior view of the pant leg of FIG. 1 with the exposed primary pocket opening being visible as may employed in accord with embodiments.

FIG. 3 shows fabric wrong side views of pant leg panels with interfacing as may be employed in accord with embodiments.

FIG. 5 shows two pant panels, with their fabric right-side facing towards each other, stitched together along a long edge and with a seam allowance as may be employed in accord with embodiments.

FIG. 6 shows upper primary pocket panels that have been serged and are stitched together along multiple sides and with a seam allowance, as may be employed in accord with embodiments.

FIG. 7 shows subordinate security pocket panels that have been serged and stitched together along multiple sides and with a seam allowance, as may be employed in accord with embodiments.

FIG. 8 shows an inside view of pant leg panels and upper primary pocket panels as may be positioned and stitched during assembly in accord with embodiments.

FIG. 9 shows an inside view of pant leg panels and upper primary pocket panels as may be positioned and stitched during assembly in accord with embodiments.

FIG. 10 shows an inside view of pant leg panels and upper primary-pocket panels as may be positioned and clipped during assembly in accord with embodiments.

FIG. 11 shows the fabric right-side of front and back pant leg panels as may be top stitched along side seams during assembly in accord with embodiments.

FIG. 12 shows an inside view of pant leg panels, upper primary pocket panels, and subordinate security pocket panels as may be positioned and stitched during assembly in accord with embodiments.

FIG. 13 shows an inside view of pant leg panels, upper primary pocket panels, and subordinate security pocket panels as may be positioned and stitched during assembly in accord with embodiments.

FIG. 14 shows an inside view of pant leg panels, upper primary pocket panels, and subordinate security pocket panels as may be positioned and stitched during assembly in accord with embodiments.

FIG. 15 shows an inside view of pant leg panels, upper primary pocket panels, and subordinate security pocket panels as may be positioned, stitched, and clipped during assembly in accord with embodiments.

FIG. 16 shows an inside view of pant leg panels, upper primary pocket panels, and subordinate security pocket panels as may be positioned and tack stitched during assembly in accord with embodiments.

DETAILED DESCRIPTION

Figure 1:
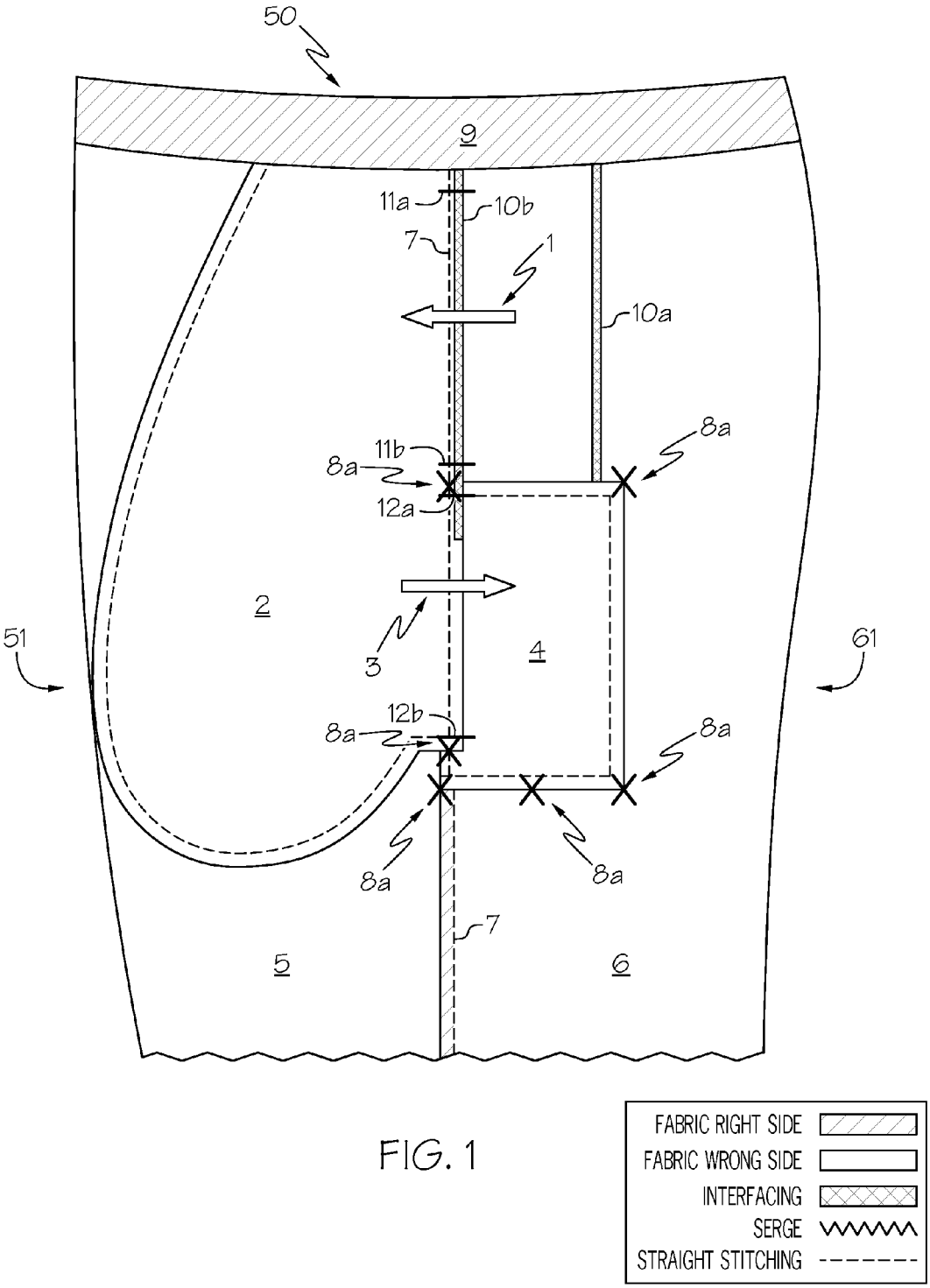
FIG. 1 shows an inside view of features of a right pant leg employing an upper primary pocket and a subordinate security pocket as may be employed in accord with embodiments.

Embodiments may include multiple pocket systems orientated along a seam or other shared axis of positioning where a primary pocket is provided and a subordinate secondary pocket is accessible through the primary pocket. In embodiments, the primary pocket may be positioned completely or partially higher than the subordinate secondary security pocket and user access to the higher pocket and the subordinate security pocket may lie along the same positioning axis where access to the security pocket is primarily achieved after passing into the primary pocket. For example, in embodiments, entrance to both a primary pocket and a subordinate secondary security pocket may lie along a vertical side seam of a pant leg or other sewn article, where the direction of ordinary user access to the primary pocket traverses a first seam axis in a first direction and where ordinary user access to the subordinate secondary security pocket traverses the first seam axis in a second and opposite direction to the first direction.

When the sewn article is a pant leg, for example, the primary pocket may be accessed from the outside of the garment by moving a wearer's hand forward, across a vertical reference seam and down into the primary pocket, while the subordinate secondary security pocket may then be accessed by subsequently moving the wearer's hand down further into the primary pocket and back across the vertical reference seam in the opposite direction, i.e., backwards and into the subordinate security pocket. This method of access to the subordinate pocket may be described as a serpentine access path moving back and forth over an axis where the first direction is backward and the second direction is forwards. In this and other embodiments the openings to the pockets may lie directly or nearly adjacent another along the same axis. This same orientation axis may be vertical as well as have other relative axis of orientation including 75°, 60°, 45°, 30°, and 15° relative to a bottom horizontal reference of the garment or non-garment when the garment or non-garment is in use.

Various reinforcements may be employed to the fabric to promote reduction in fatigue of the fabric and to promote a bias for each pocket to rest in a closed position during use. In other words, stitching and surging and interfacing may be employed in conjunction with, between and to layers of fabric to bias the primary pocket to lay closed while in use. Likewise, stitching and surging and interfacing may be employed in conjunction with, between and to layers of fabric to bias the security pocket to lie closed while in use. Still further, positioning the openings of both pockets atop one another or along a shared seam or both may promote closing of their openings when the garment or sewn fabric item is in a substantially upright orientation due to loading of the seam by items placed in the pockets. Similarly, tension may be created along a shared reference seam in other ways such that each pocket or at least one of the pockets is biased to be closed in an ordinary orientation. For example, a gym bag or piece of soft-sided luggage or backpack may include elastic or biasers above or below the shared seam to bias one or both pockets closed. Other configurations may also be possible.

As noted, a primary pocket and subordinate secondary security pocket may be used in various garments comprising jackets, pants, shirts, skirts, shorts, and coats. Similarly, a primary pocket and subordinate secondary pocket may also be used in various other sewn items such as soft-sided luggage, soft-sided hand bags, back-packs, and other sewn items as well. These garments and non-garments may be constructed from multiple layers of fabric including wool, cotton, denim, polyester, and combinations thereof. Likewise, fabrics of various ranges of flexibility, distortion, and strength may be used. These may comprise silk, lycra, polyester, leather, cotton, wool, and denim.

Embodiments may benefit from aligning the primary pocket along a shared vertical, near-vertical, or upright reference as the secondary security pocket and providing for a serpentine access path to the secondary security pocket from and through the primary pocket, across the vertical, near-vertical or upright reference and into the secondary security pocket. Still further, by having the primary pocket aligned in a first direction away from a seam serving as the reference axis and the secondary pocket aligned in a secondary direction away from the shared reference axis, the entrance to the secondary pocket may be held closed or relatively closed by weight of the sewn item below the pockets. Moreover, when the pockets are so oriented in pants, an object placed in the secondary pocket, when the secondary security pocket is aligned behind a shared reference seam, may swing more comfortably and may be less likely to disturb the wearer of the pants. Comparably, when items are placed in the primary pocket, when the primary pocket is in front of the seam, items placed in the primary pocket may bounce out and back into the leg of the wearer. Thus, embodiments may be beneficial in the comfort they offer a wearer by aligning the secondary security pocket along natural swing lines of a leg of a wearer.

Still further, embodiments may be beneficial by serving to reliably hold items in the secondary pocket with limited or no need for additional binding securements such as hook and loop fasteners, buttons, and zippers. In other words, the alignment of the opening of the secondary security pocket along a shared upright seam may serve to reliably hold items in the secondary pocket. This may include holding items in loose fabric pants such as sweat pants and loose jackets, such as golf pull-over wind breakers.

Additional features of the dual pocket system and sewn item may also serve to reliably hold items in the secondary security pocket. This may include positioning interfacing along pocket openings and along anticipated tension lines in the fabric. This selective positioning may serve to reduce fatigue stretching or other distortion of the fabric over time. This may also include tack securing the secondary security pocket in a certain fixed position and placing fatigue tacks at the joints of pocket opening seams or elsewhere in the sewn item. In preferred embodiments the tack stitching may be employed in corners of the security pocket, along a bottom edge and in an upper corner for purposes of holding the security pocket behind a vertical reference seam, the same vertical reference seam in which the primary pocket is positioned in front of.

As also described herein, methods of manufacture and other processes may also practice and fall within embodiments. These may include processes of assembly of new articles as well as processes to adapt existing articles and the like using the teachings provided herein.

Referring to FIG. 1, a garment 50, such as a pant as may be employed in embodiments, is shown disposed in an inside-out position. FIG. 1 shows a right pant leg comprising front pant panel 5 and back pant panel 6 in which the garment (a pair of pants) has two substantially identical pant legs both with the side and security pockets. In other words, a pant panel 5 and 6 may be joined to form a pant leg and they may be sewn to another pant leg to form a pair of pants.

The unfinished pant of FIG. 1 comprises two pockets, 2 and 4, that may be joined along the side seam 7 of the pant in accord with embodiments. As shown the first pocket in embodiments may be basically a standard side pocket 2 on the front side of the leg of the pant 5 with its opening positioned between 11*a* and 11*b* and located near the top of the side seam 7 right below the waistband 9 which can be accessed from outside of the pant. Directly below the opening to the side pocket 2, along the side seam 7, is the opening to the security pocket 4, positioned between 12*a* and 12*b*, which may be created by joining seam allowances of the side and security pockets, 2 and 4, may also be provided in embodiments.

The security pocket 4 of FIG. 1 is located on the back side 61 of the leg of the pant 6 and its interior may only be accessed by reaching into the side pocket 2 via arrow 1 and then reaching back towards the side seam 7 via arrow 3 where the opening to the security pocket is located. Therefore, in embodiments, the opening to the security pocket 4 may be located inside of the side pocket 2 along the side seam 7 and, in so doing, access to inside the security pocket 4 may solely be through the opening to the side pocket via arrow 1 into the side pocket 2 and then through the opening to the security pocket via arrow 3.

In embodiments, the security pocket 4 may be tacked to the back side of the leg of the pant 6 on the top left and right corner, the bottom left and right corner, and the middle of the bottom of the pocket, all marked by an "X" and labeled 8*a* in FIG. 1. In embodiments this or other configurations may bias the openings of the pockets such that during the majority of use the security pocket 4 stays predominantly or completely flush against the back side of the leg of the pant 6 to promote that items inside of the security pocket don't shift the pocket position while moving around.

In embodiments, the opening 1 to the side pocket 2 may be created by joining a hidden layer of the side pocket 2 to the front of the leg of the pant 5 at the side seam 7 and the top layer of the side pocket 2 to the back of the leg of the pant 6 at the side seam 7. As can also be seen in FIG. 1, embodiments may also include non-stretch fusible interfacing pieces 10*b* on the front and back of the side seam allowance located at the opening to the side pocket 2 and the top quarter portion of the opening to the security pocket 4 at the side seam 7 and in so doing, the opening to the side pocket 2 and the opening to security pocket 4 may not be stretched out over a number of uses. Or perhaps, the amount of fatigue deformation of the fabric comprising the pant or other sewn item may be reduced or substantially eliminated.

As described in more detail below, in embodiments, the opening to the security pocket 4, which may be formed when the top layer of the side pocket 2, located at the opening to the security pocket 4 may be stitched to the top layer of the security pocket 4. Subsequent to this stitching or concurrent with it, the hidden layer of both the side pocket 2 and the security pocket 4, located at the opening of the security pocket 4, may be stitched to each other and then also stitched to the side seam 7. As can also be seen, the bottom right corner of the side pocket 2 may be tacked to the security pocket 4 at the seam allowance as shown by the "X"s labeled 8*a* in FIG. 1. These alignments and processes may serve to create an opening to the security pocket 4 located along the side seam 7. Furthermore, in so doing, the bottom of the security pocket 4 may be positioned slightly lower than the opening to the security pocket 4, which can serve to provide the security pocket 4 some vertical depth. In embodiments these positions and relative dimensions may differ as well.

As noted above, a non-stretch fusible fabric strip 10*a* may be added, on the back side of the leg of the pant 6 oriented slightly to the left of tack 8*a* on the top right corner of the security pocket 4, from the bottom of the waistband 9 to slightly below the top of the security pocket 4 in order to prevent stretching in that area of the pant caused by the weight of any item inside the security pocket 4. The fusible fabric strip may be necessary or preferred when the fabric used for the pants is stretchable.

Embodiments may, therefore, may use the ordinary or customary loading and manner in which pants lay and move when being worn on the leg by selecting the vertical side seam 7 as the location for the openings to the side pocket 2 and the security pocket 4. In so doing, in embodiments, the side pocket 2 may preferably or always stay on the front side 51 of the leg of the pant 5 and the security pocket 4 may preferably or always stays on the back side 61 of the leg of the pant 6. The placement and construction of the opening to the security pocket 4 and the placement of both the side and security pockets, 2 and 4, may independently or together serve to act and influence with how pants lay on the leg of a user and promote that once an item is placed inside the security pocket 4 it is unlikely or almost impossible for it to slide back into the side pocket 2. Therefore, embodiments may be well suited for placing valuable items such as a cell phone, wallet, or keys as they can be secure, with little to de minimus risk of falling out of the security pocket, and may also be hidden to others unfamiliar with the dual pocket system, promoting security for unwanted removal of items from the subordinate secondary security pocket.

Still further, the positioning of the secondary security pocket relative to the natural movement of the leg of a wearer, can also serve to improve the comfort for a wearer as items placed in the secondary security pocket may be less likely to bounce out and into the leg of the wearer as compared to swinging back and forth, much like a pendulum and more consistent with the gait of the wearer. For example, while running, the placement of the secondary pocket 4 on the back side 61 of leg of the pant 6 right next to the side seam 7 the secondary pocket 4 may be considered right against the side of a user's thigh. Since the items are located on the side of the thigh while running or in other movements the items will likely move with a user's leg instead, swinging along the same general direction as the gait of the user as compared to bouncing outward and towards the front of a user's thigh. This positioning can serve to make for a far more comfortable garment and promote more comfortable storage of items while running, hiking, or doing any other activity with extensive motion. In embodiments, garments may be a sweat pant as well as dress pants, jeans, skirts, dresses, jackets, and shorts for men, women, and children, or even other sewn items such as non-garment gym bags and or waist bags worn around the waist of a user.

FIG. 2 shows an outside view of a pocket system as may be employed in a right pant leg of a pair of pants in accord with embodiments. Arrow 21 shows how items in pocket 4 may swing as the pants are worn, much like a pendulum swinging about its axis of swing. Vector point 22 shows how an item in pocket 2 may move out of the page and away from the leg of a wearer of the pants. Also shown are the seam 7, the pocket opening 100, the side pocket 2, the pocket opening 300, the security pocket 4, and the waistband 9. The only thing that may be visible from the outside of the pants is the pocket opening 100.

FIGS. 3-16 show aspects, including aspects of assembly, of a multiple pocket system with a side and security pocket in a left pant leg as may be employed for a pair of pants or other garment or personal effect or non-garment employing one or more security pockets in accord with embodiments. FIG. 3 shows front pant leg panel 5 and back pant leg panel 6 on the left side of a pant leg from an inside view and the wrong side of the fabric of each panel being shown. As can be seen interfacing has been ironed onto the fabric starting at the top of the opening to the side pocket and ending slightly below the bottom of the opening of the side pocket of the completed pant. Interfacing 10*b* is shown on both panels 5 and 6 while interfacing 10*a*, which extends from the top of the pant panel 6, through the waist-band area, and down past the other interfacing, is only shown on one panel representing the back side of the leg of the pant 6. As noted above, interfacing 10*b* may serve to inhibit fabric fatigue at of the opening to the side pocket and security pocket. Fold lines 31, and 32 are shown and may be the location of where the top edge of each pant panel is folded down during assembly to form a waistband and channel for acceptance of a tie for tightening the assembled pants when worn. The opening of the primary pocket may begin at stitch marker 33 and end at stitch marker 34. In other words, the side pocket opening 30, once fully assembled, may begin at point 33 and end at point 34. The manner in which the interfacing 10*b* can serve to reinforce the pocket can be seen because of their proximity to stitch markers 33 and 34.

In embodiments, during assembly, the cut pieces comprising the interfacing 10*b* may be fused to the opening of the wrong side of the side pockets of front and back panels 5 and 6, which can inhibit or prevent pocket openings to stretch out. Also during assembly, longer interface piece 10*a* may be fused onto the back panel 6 of the pant leg, about 3.5 inches away from the side seams. This positing and sizing can serve to counter balance gravity when a user moves around with heavier contents in his or her security pocket. As in this and other embodiments described herein other positioning and sizing may also be possible. Still further features described herein may be used in part and in various combinations with those described herein.

Figure 4:
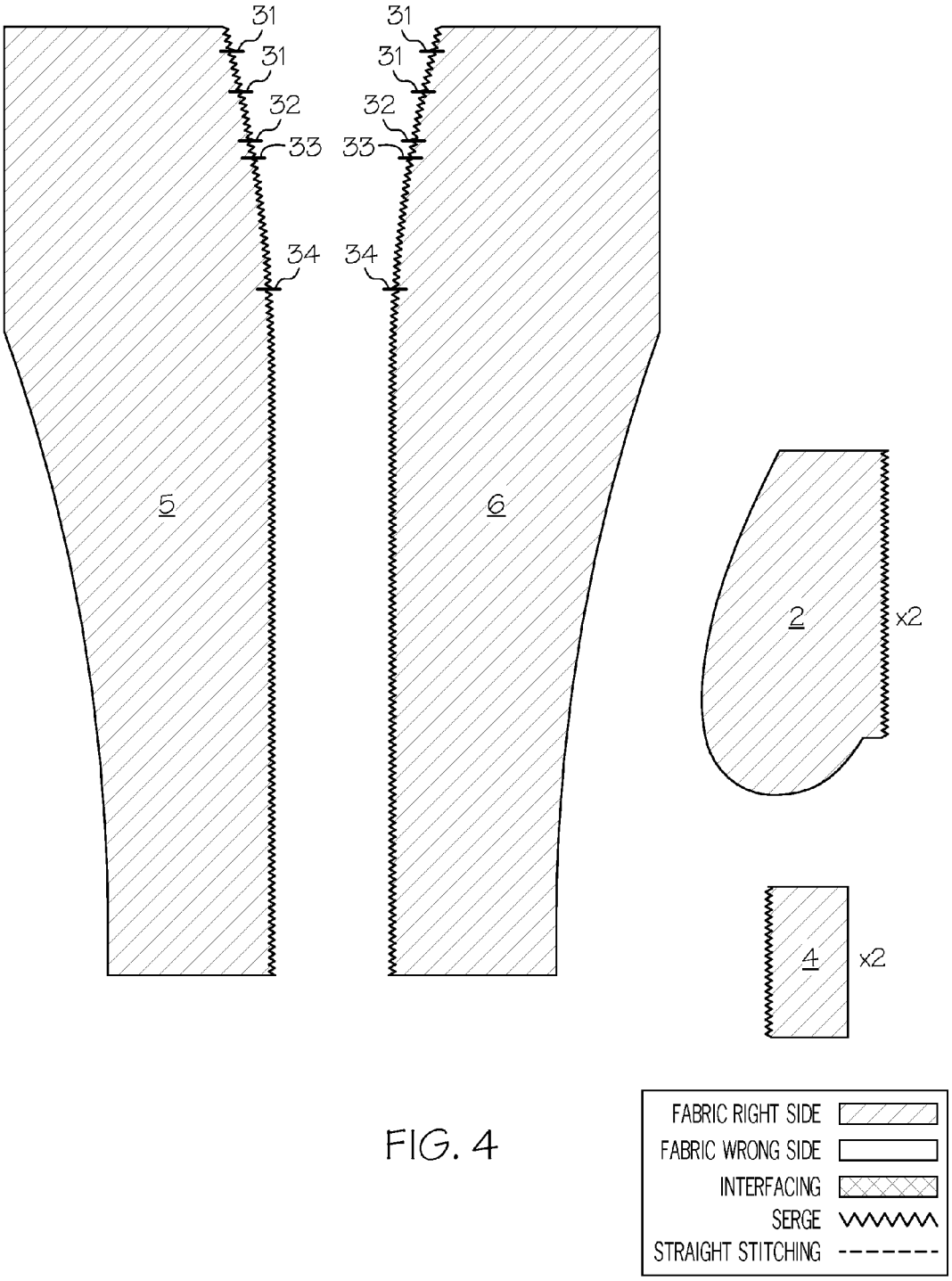
FIG. 4 shows fabric right-side views of pant leg panels, primary pocket panels, and subordinate security pocket panels as may be employed in accord with embodiments.

FIG. 4 shows the right-side of the fabric for pant leg panels 5 and 6 on the left side of a pant leg as well as the fold lines 31 and 32, and the side pocket stitch markers 33 and 34. Also shown are the right-side of the fabric for side pocket 2 and security pocket 4 with the indication "x2" to signify that that two pieces of each fabric are needed for construction. As can be seen, during assembly of the pants, edges of the pant leg panels, as well as the pocket panels, may each be serged ahead of further sewing the pieces together. Thus, FIG. 4 shows that during assembly in accord with embodiments side seams of pant leg panels 5 and 6 may be serged and the opening sides of the pocket panels 2 and 4 may be serged as well.

FIG. 5 shows how right-sides of the fabric of panels 5 and 6 may be facing each other and side seams may be joined with sections for the waistband tie channel 50 and the side pocket opening 100 being left unstitched. Shown in FIG. 5 are fold lines 51, 53 and 54 as well as stitch markers 55 and 56. These fold lines and stitch markers can serve to form and delineate where the waistband tie channel 50 and the side pocket opening 100 may be formed in the pant leg. Thus, as can be seen in FIG. 5, right sides of the pant leg panels may be together joined along a side seam of front and back pant panels 5 and 6, leaving the opening 100 of the side pocket unstitched and the waistband channel 50 between 51 and 53 unstitched. Arrow 58 shows a folded corner and the right-side of the fabric of both panels for illustrative purposes. Fabric in embodiments may have a weight of less than 1000 g per square meter.

FIG. 6 shows side pocket panels 66 and 67 with their fabric right-sides facing together. Also visible are serged edge 65 and openings 100 and 300. Opening 100 may be bordered by reinforcing stitching 68 and 69 while opening 300 may be bordered by stitching 69 stitch marker 63. In embodiments, during assembly, hidden layer panel 66 of side pocket 2 may be sewn to the top layer panel 67 of side pocket 2 all around the pocket, as shown by stitching 62, except the pocket openings 100 and 300 and curved sides of hidden layer 66 and top layer 67 of side pocket 2 may be serged together 65.

FIG. 7 shows assembly of the subordinate security pocket 4 as may be carried out in accordance with embodiments. As can be seen, during assembly the fabric right-sides may be stitched together, as shown by stitching 78, by sewing hidden layer 4*b* of security pocket 4 to top layer 4*a* of security pocket 4 at all sides except pocket opening 300 located between markers 75 and 76. Then serge together 79 both the hidden layer 4*b* and top layer 4*a* on all three sides of the security pocket 4, leaving the side with the pocket opening 300 unserged. Then individually serge 77 the hidden layer 4*a* and top layer 4*b* of the security pocket 4 on the side of the pocket opening 300. Stitching markers 75 and 76 are shown for purposes of locating where the opening 300 to the subordinate security pocket 4 may be located in embodiments.

FIG. 8 shows the hidden layer 2*b* of side pocket 2 facing forward with the right-side of the side seam folded back to show the seam allowance 830. As can also be seen in FIG. 8 during assembly the hidden layer 2*b* of the side pocket panel 2 may be sewn to the front leg panel of the pant 5 at the side pocket opening 100. Thus, stitching between the hidden layer 2*b* of the side pocket 2 and the front panel of the pant 5 may be sewn between sewing points 81 and 83, there by securing these panels together and forming a portion of the opening for the side pocket 100. In preferred embodiments, the vertical seams may be pressed open, then closed and pressed again. This pressing may serve to form a crease for easing assembly of the pockets and for serging layers of applicable fabric in subsequent steps.

FIG. 9 shows how the side pocket 2 may be flipped along the side seam, so the top layer 2*a* of the side pocket 2 is showing, such that additional stitching may be carried out to top stitch the pocket opening 100 in the side pocket 2 located between markers 94 and 95. Thus, the side seam has been turned to face inside of the pocket and top stitched ¼" along the opening 100 of the side pocket 2. This additional top stitching 90 may be added where seam allowances 91 and 92 meet between markers 94 and 95 and serves as a finishing technique to make the pocket opening match up with the top stitching of the side seam 7. This opening may now lie along seam 7.

FIG. 10 shows how during assembly the top layer 2*a* of the side pocket 2 may be sewn to the back panel of the pant leg 6 at the pocket opening 100, which is located between stitch marker 1000 and 1010. This step may create the pocket opening 100. In addition, the seam allowance of the back panel of the pant leg 6 may be clipped 102 at stitch marker 103 and the seam allowance may be pressed to the front, near and below the pocket opening 100. In addition, in alternative embodiments, the entire side seam may be pressed open.

FIG. 11 shows that the whole pant may be turned to the outside, with the right side of the fabric showing, for top stitching at the side seam 7 except for the side pocket opening 100 located between stitch markers 11*a* and 11*b* of the side pocket, which may be done earlier in embodiments.

FIG. 12 shows still further assembly processes as may be employed in embodiments. In embodiments, the wrong side of the hidden layer 4*b* of security pocket 4 may be sewn to the wrong side of the side seam using an invisible zipper foot stitch 125 at the opening of security pocket located between stitch markers 12*a* and 12*b*. In this Figure, because these panels shown as top stitched and because seam allowances are shown to be shallow, turning pant leg to opposite side of the security pocket is preferred. In so doing, the seams can be stacked in the order of front pant leg panel 5, back pant leg panel 6 and then the security pocket hidden panel 4*b*. Also visible in FIG. 12 are side seam 7, and security pocket opening points 12*a*, which may be the top of the opening and 12*b*, which may be the bottom of the opening. Alternatively this embodiment may take place between FIGS. 15 and 16 by stitching down the seam allowance of the security pocket 4 to the seam allowance of the side seam of the pant 7.

FIG. 13 shows how during assembly the hidden layer 2*b* of the side pocket 2 may be sewn at the opening 126 from 12*a* to 12*b* to the hidden layer 4*b* of the security pocket 4. So, here, in so doing, a total of 4 seam allowances may be stacked in the order of front leg panel 5, back leg panel 6, security pocket hidden panel 4*b*, and side pocket hidden panel 2*b*. Also, with the right sides together, the hidden layer 4*b* of the security pocket 4 and the hidden layer 2*b* of the side pocket 2 may instead be stitched together at the pocket opening from 12*a* to 12*b*.

FIG. 14 shows subsequent to this stacking, the side pocket 2 may be flipped to face top layer 2*a*, which is still inside of pants, and to join the seam allowances 14 of the top layer 2*a* of the side pocket 2 to the top layer 4*a* of the security pocket 4 at the opening 300 bordered by points 12*a*-12*b*. This may create the pocket opening 300 from the side pocket 2 to the security pocket 4. In some embodiments, with the right sides together, the top layer 4*a* of the security pocket 4 and the top layer 2*a* of the side pocket 2 may be stitched together at the pocket opening 300 from 12*a* to 12*b*. This, too, may create the pocket opening 300 from the side pocket 2 to the security pocket 4.

FIG. 15 shows how the seam allowance of the top layer 4*a* of security pocket 4 may be clipped 15 at 12*b*. This clipping may be done to change the direction of the seam allowance to the front side of the leg of the pant. In other words, having been clipped at 12*b*, at the opening 300, the seam allowance of the top layer 4*a* of the security pocket 4 may rest towards the back side of the pant 6 and below the opening the seam allowance of the top layer 4*a* of the secondary security pocket 4 may rest towards the front side of the pant 5.

FIG. 16 shows how security tacks 16*a*-16*f* may be stitched to hold the security pocket 4 in place and to reinforce the top and bottom corner of the opening 300 between the side pocket 2 and security pocket 4. Also visible in FIG. 16 is where a clipping may occur to promote alignment of the seam allowance from the top pocket to the security pocket.

Other processes for assembly may also be employed. For example the top layer 2*a* of the side pocket 2 shown above may be sewn to the back leg at the pocket opening rather than as described above. Also, aligning the fabric right-sides together, the hidden layer 4*b* of the security pocket 4 may be attached to the hidden layer 2*b* of the side pocket 2 at the opening of the security pocket 12*a*-12*b*. In so doing, the top layer of the security and side pocket may serve as the opening to the security pocket. Still further, the security pocket's seam allowance may be clipped at the bottom of opening 12*b* to make seam allowances to rest on the front of the leg. Subsequent to this, sew down the seam allowance of the security pocket to the seam allowance of the side seam of the pant.

Figure 17:
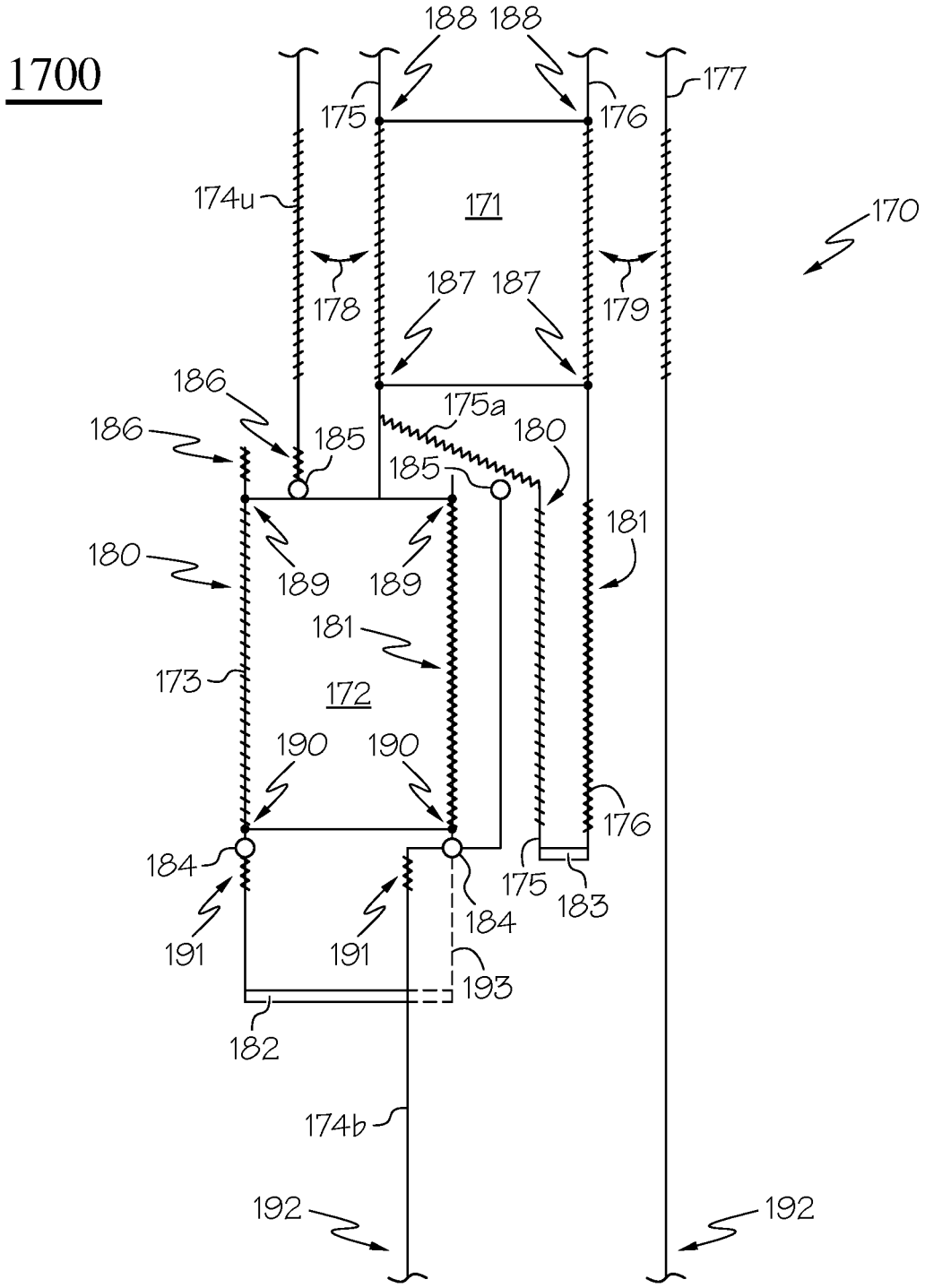
FIG. 17 shows a side view of layers of fabric along a side seam as may be aligned and secured in a pocket system in accord with embodiments.

FIG. 17 shows a side view of a side seam of a pocket system 170 as may be clipped and sewn in accord with embodiments. The pocket system 170 may be part of various items 1700, such as: pants, jackets, other garments, and totable items such as: backpacks, luggage, and bags. As can be seen, the pocket system 170 includes and upper back panel 174*u*, a lower back panel 174*b*, a side pocket top panel 175, a side pocket hidden panel 176, a security pocket top panel 173, a security pocket hidden panel 193, and a front panel 177. These panels are finished and secured to each other to form a pocket system in accord with embodiments. A top pocket opening 171 is defined by pocket opening top 188 and pocket opening bottom 187. This pocket opening 171 is also formed by stitching or serging the side pocket top panel 175 to the upper back panel 174*u* with connecting stitches 178. Likewise, the other side of the pocket defining the opening 171 may be defined by connecting stitches 179, which secure the front panel 177 to the side pocket hidden panel 176.

The security pocket opening 172 may be defined by securing the security pocket top panel 173 and the side pocket top panel 175 with connecting stitches 180 on one side and by securing the security pocket hidden panel 193 to the side pocket hidden panel 176 along connecting stitches 181. In so doing, access to the security pocket may be obtained by reaching down and through the side pocket opening and through the security pocket opening in a serpentine type fashion. Connecting stitches defining the side pocket opening are labeled at 188 for the top of the opening and 187 for the bottom of the opening of the top pocket. Similarly, connecting stitches defining the security pocket opening are shown at 189 for the top of the opening of the security pocket and at 190 for the bottom of the opening of the security pocket. Security pocket bottom seam is shown at 182 and side pocket bottom seam is shown at 183. As can be seen in FIG. 17 the side need not extend past the bottom of the security pocket in this Figure because details of the seam are provided therein. However, in this and other embodiments the side pocket may extend past the security pocket away from the side seam itself as shown in the Figure and elsewhere. In other embodiments the side pocket may not extend past the security pocket and may be even with it as well. The seam allowances have been clipped at 185 and 184 to allow the seam allowances to be manipulated in order to form the alignment of the pocket openings described herein. Also shown in FIG. 17 are connecting stitches 186 and 191. These stitches serve to hold the identified layers of fabric to one another and further serve as securements for the security pocket. The side pocket top panel 175 is shown with a jog 175*a* to allow for better detail of the layers and their respective alignments and securements. In embodiments this layer may or may not be clipped along its length. Likewise, while the back panel and the security pocket front panel are shown with clips 185 and 184 respectively, other seam allowances may be clipped instead or in addition to. Adjacent panels after the pockets are shown at 192. Still further, seam allowances of the hidden layer of the side pocket and the seam allowances of the hidden layer of the security pocket may be further stitched down to the side seam in embodiments. An example of this stitching configuration is also described with FIG. 12. In so doing, additional security may be provided to the security to retard unnecessary movement and access to the security pocket may be promoted because the security pocket is biased into relatively stable position.

The foregoing description is intended for purposes of illustration. This invention may be embodied in other forms or carried out in other ways without departing from the spirit or scope of the invention. Modifications and variations still falling within the spirit or scope of the invention. For example, fewer layers of fabric may be used to comprise the pocket system. In so doing, the back and front panels may themselves be a single sheet that is cut at appropriate locations to correspond with two panels described above instead. Still further, other fabric panels shown as different layers may also be taken from the same layer of fabric and cut as well to correspond to the two panel associations described herein.

The terminology used herein is for the purpose of describing particular embodiments only and is not intended to be limiting of the invention. As used herein, the singular forms "a," "an" and "the" are intended to include plural forms as well, unless the context clearly indicates otherwise. It will be further understood that the terms "comprises" and/or "comprising," when used in this specification, specific the presence of stated features, integers, steps, operations, elements, and/or components, but do not preclude the presence or addition of one or more other features, integers, steps, operation, elements, components, and/or groups thereof.

The description of the present invention has been presented for purposes of illustration and description, but is not intended to be exhaustive or limited to the invention in the form disclosed. Many modifications and variations will be apparent to those of ordinary skill without departing from the scope and spirit of the invention. The embodiment was chosen and described in order to best explain the principles of the invention and the practical application, and to enable others of ordinary skill in the art to understand the invention for embodiments with various modifications as are suited to the particular use contemplated.

What is claimed is:

1. A fabric pocket system comprising:

an upper pocket having an opening and an interior; and a security pocket having an opening and an interior, the upper pocket opening configured to permit access to the upper pocket interior, the security pocket opening configured to permit access to the security pocket interior, the security pocket interior solely accessible through the interior of the upper pocket, wherein each pocket is comprised of fabric, the opening of the upper pocket lies along a seam of a pant leg, the opening of the security pocket lies along the same seam of the pant leg as the opening of the upper pocket and is accessible in a direction opposite to the direction of access for the opening of the upper pocket, and at least a portion of a bottom of the opening of the security pocket is secured to the pant leg.

2. The pocket system of claim 1 wherein the pant leg is comprised of merino wool fabric or cotton fabric or polyester fabric or any other fabric or combination thereof other than denim.

3. The pocket system of claim 1 wherein the security pocket is oriented to a backside of a wearer of the pant leg and the upper pocket is oriented towards a front side of the wearer of the pant leg, wherein at least a portion of the security pocket is secured to the pant leg seam, and wherein at least a portion of the upper pocket is not secured to the pant leg.

4. The pocket system of claim 1 wherein the pant leg is comprised of denim.

5. The pocket system of claim 1 wherein the opening of the security pocket is below the opening of the first upper pocket and wherein a lower seam of the security pocket and a lower seam of the upper pocket are not positioned on the same piece of fabric.

6. The pocket system of claim 1 wherein at least a portion of the upper pocket below the top location and at least a portion of the security pocket below the top location are secured to the seam.

7. The pocket system of claim 1 wherein a ledge is formed between the upper pocket and the security pocket.

8. The pocket system of claim 1 wherein at least a portion of the security pocket opening is secured to the pant leg and wherein there is an offset between the security pocket and the upper pocket.

9. A method of assembling a pocket system comprising:

sewing two or more layers of fabric together to form a primary pocket; and sewing two or more layers of fabric together to form a secondary pocket, the two or more layers of fabric for the secondary pocket apart from the two or more layers of fabric for the primary pocket wherein the primary pocket is an upper pocket having an opening and an interior;

the secondary pocket is a security pocket having an opening and an interior, the secondary pocket opening having a top location at which its opening begins and a bottom location at which its opening ends;

wherein the primary pocket opening is configured for accessing the primary pocket's interior, the secondary pocket's opening is configured for accessing the secondary pocket's interior, and the secondary pocket's interior is solely accessible through the interior of the primary pocket, wherein the opening of the primary pocket lies along a non-horizontal seam of a pant leg, and wherein the opening of the secondary security pocket lies along the same seam of the pant leg as the opening of the primary pocket and is accessible in a direction opposite to the direction of access for the opening of the primary pocket.

10. The method of claim 9 wherein the fabric has a weight of less than 1000 g per square meter.

11. The method of claim 9 wherein the primary pocket has a bottom and the secondary pocket has a bottom wherein the bottom of the primary pocket extends below the bottom of the secondary pocket and is noncontinuous with the bottom of the secondary pocket.

12. The method of claim 9 wherein at least a portion of the primary pocket is secured to the pant leg below the top location and at least a portion of the secondary pocket is secured to the pant leg below the top location.

13. A sewn item having a pocket system comprising:

a first layer of fabric material, a second layer of fabric material, a third layer of fabric material and a fourth layer of fabric material;

a first set of two or more of the four layers of fabric material sewn together to define a primary pocket with a first opening, the first opening accessible from outside the sewn item;

a second set of two or more of the four layers of fabric material sewn together to define a security pocket with a security pocket opening and a security pocket interior, the security pocket opening only accessible via the primary pocket;

the security pocket opening and the first opening are oriented along a shared seam of the sewn item;

the security pocket opening and the first opening have a fixed position relative to the sewn item; and the interior of the security pocket solely reachable through the opening of the primary pocket via a serpentine access path that crosses the shared seam in a first direction to enter the primary pocket and then crosses the shared seam in the opposite direction across the shared seam to enter the security pocket from inside the primary pocket.

14. The sewn item of claim 13 wherein the item is a jacket or tote or luggage or garment other than a jacket.

15. The sewn item of claim 14 wherein the seam is not horizontal and wherein the garment comprises at least one of a skirt or shorts.

16. The sewn item of claim 13 wherein the item is a pair of pants and wherein the seam is between a 45° and 90° angle relative to a waistband of the pants.

17. The sewn item of claim 13 wherein the seam is a vertical seam.

18. The sewn item of claim 13 wherein the security pocket opening does not overlap with the opening of the primary pocket.

19. The sewn item of claim 13 where the security pocket opening does overlap with the opening of the primary pocket and wherein the shared seam is a vertical seam of a backpack.

* * * * *